US005758553A

United States Patent [19]

Perry

[11] Patent Number: 5,758,553

[45] **Date of Patent: *Jun. 2, 1998**

[54] BREAK DOWN TONG APPARATUS

[76] Inventor: Robert G. Perry, 5335 E. Terrace Ave., Indianapolis, Ind. 46203

[ * ] Notice: The term of this patent shall not extend beyond the expiration date of Pat. No. 5,740,703.

[21] Appl. No.: 625,397

[22] Filed: Mar. 27, 1996

Related U.S. Application Data

[63] Continuation-in-part of Ser. No. 374,959, Jan. 19, 1995, abandoned.

[51] Int. Cl.[6] ..... B25B 13/50

[52] U.S. Cl. ..... 81/57.34; 81/57.36; 81/57.41

[58] Field of Search ..... 81/57.33, 57.34, 81/57.35, 57.36, 57.4, 57.41, 57.42, 57.15, 57.16, 57.24, 57.22, 57.25, 57.19, 57.2, 423; 269/20, 25, 27, 31, 32, 34

[56] References Cited

U.S. PATENT DOCUMENTS

| | | | |
|---|---|---|---|
| 676,292 | 6/1901 | Wigtel | 269/25 |
| 1,216,527 | 2/1917 | Weldon et al. | 81/423 |
| 1,430,226 | 9/1922 | Goodreau | 269/27 |
| 2,150,611 | 3/1939 | Speck . | |
| 2,398,658 | 4/1946 | Mead | 269/34 |
| 2,405,757 | 8/1946 | Rowland . | |
| 2,509,853 | 5/1950 | Wilson . | |
| 2,552,521 | 5/1951 | Coshow . | |
| 2,668,689 | 2/1954 | Cormany . | |
| 2,862,690 | 12/1958 | Mason . | |
| 2,952,177 | 9/1960 | Skillin . | |
| 2,979,320 | 4/1961 | Adams . | |
| 3,025,733 | 3/1962 | Soodnizin | 81/57.19 |
| 3,203,737 | 8/1965 | Robbins et al. . | |
| 3,227,419 | 1/1966 | Lackey . | |
| 3,521,509 | 7/1970 | Duke et al. . | |
| 3,550,485 | 12/1970 | Dickmann . | |
| 3,726,506 | 4/1973 | Vanderwaal et al. . | |
| 3,799,010 | 3/1974 | Guier . | |
| 3,807,695 | 4/1974 | Gremillion et al. . | |
| 3,832,918 | 9/1974 | Lang et al. . | |
| 3,834,668 | 9/1974 | Casey . | |
| 3,907,253 | 9/1975 | Schosek . | |
| 3,951,216 | 4/1976 | Crawshay et al. . | |
| 3,957,113 | 5/1976 | Jones et al. . | |
| 4,000,879 | 1/1977 | Martin et al. . | |
| 4,082,017 | 4/1978 | Eckel | 81/57.34 |
| 4,092,881 | 6/1978 | Jürgens et al. . | |
| 4,095,493 | 6/1978 | Haynes . | |
| 4,170,907 | 10/1979 | Cathcart . | |
| 4,246,809 | 1/1981 | Keast et al. . | |
| 4,333,365 | 6/1982 | Perry . | |
| 4,368,873 | 1/1983 | Perry . | |

(List continued on next page.)

FOREIGN PATENT DOCUMENTS

| | | |
|---|---|---|
| 694604 | 10/1979 | U.S.S.R. . |

*Primary Examiner*—D. S. Meislin
*Assistant Examiner*—Joni B. Danganan
*Attorney, Agent, or Firm*—Barnes & Thornburg

[57] ABSTRACT

A tong apparatus is provided for gripping a pipe. The apparatus includes a base and a housing coupled to the base. The housing is formed to include an interior region having a top opening. The apparatus also includes a jaw assembly extending through the top opening and into the interior region of the housing. The jaw assembly includes a lower clamp portion having a lower jaw, a linkage having a lower end coupled to the lower clamp portion and an upper end, and a cylinder having a movable piston. The cylinder is coupled to the upper end of the linkage. The apparatus further includes an upper clamp portion having an upper jaw, the upper clamp portion being coupled to the piston, and at least one removable stop extending through the housing adjacent the top opening. The at least one stop is located between the upper clamp portion and the cylinder to provide a mechanical stop for engaging the upper clamp portion upon retraction of the piston so that further retraction of the piston positively drives the cylinder, the linkage, and the lower clamp portion downwardly relative to the housing to disengage the lower jaw from the pipe.

22 Claims, 7 Drawing Sheets

U.S. PATENT DOCUMENTS

| | | | |
|---|---|---|---|
| 4,402,239 | 9/1983 | Mooney | 81/57.19 |
| 4,574,664 | 3/1986 | Curry | 81/57.19 |
| 4,732,061 | 3/1988 | Dinsdale | 81/57.34 |
| 4,821,814 | 4/1989 | Willis et al. . | |
| 4,936,708 | 6/1990 | Perry . | |
| 5,015,124 | 5/1991 | Perry . | |
| 5,133,536 | 7/1992 | Goodman | 269/25 |
| 5,231,899 | 8/1993 | Lee . | |
| 5,520,072 | 5/1996 | Perry | 81/57.16 |

BREAK DOWN TONG APPARATUS

BACKGROUND AND SUMMARY OF THE INVENTION

This application is a continuation-in-part of U.S. application Ser. No. 08/374,959, filed Jan. 19, 1995 now abandoned.

The present invention relates to an improved break down tong apparatus. More particularly, the present invention relates to a power tong apparatus and a cooperating backup tong apparatus for breaking connections between links of pipe as the pipe is being removed from the ground.

It is well known to push a rod or pipe through the ground with a drilling rig from one location to another predetermined location beneath the surface of the ground. For example, a pipe may be pushed under a road from one side of the road to another without creating a trench in the road. Generally speaking, apparatus for directing forward movement of a pipe through the ground beneath the surface of the ground are known in the art. Drilling rigs are also used to drill into the ground for oil wells or the like. Typically, these drilling rigs rotate the pipe in a counterclockwise direction or a clockwise direction to install or remove pipe from the ground.

Making and breaking apparatus are known for making up or breaking out joints between adjacent pipes which are driven into the ground with known drilling rigs. As the pipe is being removed from the ground, joints between adjacent sections must be loosened to permit the next section of pipe to be removed from the ground.

The power tong apparatus of the present invention includes two separate tongs operating in conjunction with each other. A backup tong is provided to grip and hold a lower section of pipe which extends into the ground stationary. A power tong is provided to grip and rotate an upper section of pipe which is connected to the lower section of pipe in the ground. While the backup tong prevents rotation of the lower length of pipe, the power tong grips and rotates the upper section of pipe to break the joint connection between the upper and lower pipe sections.

The jaw assembly of the present invention includes upper and lower jaws controlled by a piston and cylinder arrangement. The upper jaw is coupled to the piston and the lower jaw is coupled to the cylinder by a linkage. One important feature of the present invention is the provision of an improved jaw assembly that provides both positive raising and positive lowering of the cylinder. In other words, the improved jaw assembly of the present invention provides a driving force to move both the upper jaw and the lower jaw into engagement with the pipe. In addition, the improved jaw assembly of the present invention also provides a positive driving force to move both the upper jaw away and the lower jaw away from the pipe. This feature is accomplished through the use of a positive mechanical stop coupled to a housing of the jaw assembly as discussed below. Advantageously, the positive driving jaw assembly permits excellent operation of the jaw assembly in cold weather or in muddy conditions. Without the positive driving feature of the present invention, ice or mud can build up inside the housing and prevent the lower jaw from dropping down away from the pipe. With the positive driving feature of the present invention, however, the lower jaw is positively driven away from the pipe to ensure that the lower jaw is disengaged from the pipe.

Another important feature of the present invention is the provision of an improved structure and assembly of the jaw assembly. An upper clamp portion is formed to include a track or groove which is slidably coupled to a piston which is formed to include notched sections. A lower jaw portion includes a pair of tabs which are slidably coupled to grooves formed in first and second side walls of the linkage. Both the upper and lower clamp portions are held in position in the jaw assembly by a housing which surrounds the lower end of the jaw assembly. Advantageously, no tools or welding are required to change the upper and lower clamp portions. Therefore, the jaw assembly of the present invention is cheaper to build and stronger than conventional devices, while using less steel.

Yet another important feature of the present invention is the provision of an improved bearing for rotatably coupling the power tong to a base. No welding or bolting is required with the improved bearing apparatus. The improved bearing provides a circular bearing member which extends between annular grooves formed in the housing and annular grooves formed in support members coupled to the base. Advantageously, the circular bearing can be heat treated so that the metal of the circular bearing is harder than the metal in the support and the housing. This prevents galling during rotation of the jaw assembly. Therefore, the improved bearing of the present invention has a very long life span and is very strong. The circular bearing must be sheared in order to break it.

One prior pipe clamping mechanism is illustrated in U.S. Pat. No. 4,368,873. The '873 device includes upper and lower jaws mounted on spaced apart rods. The '873 device does not include any type of positive stops for driving the lower jaw downwardly away from the pipe as in the present invention. In addition, there is no disclosure or suggestion in the '873 patent of rotating the disclosed clamping device. Therefore, the '873 patent does not disclose or suggest the improved circular bearing member of the present invention. Finally, the '873 patent does not disclose or suggest the improved coupling of the upper and lower jaws to a jaw assembly in accordance with the present invention. The present invention advantageously provides a stronger and cheaper apparatus with fewer moving parts than the '873 patent. The improved jaw assembly of the present invention facilitates replacement of the upper and lower clamp portions without the use of any tools. Accordingly, the apparatus of the present invention provides a substantial improvement over the device of the '873 patent.

According to one aspect of the present invention, a tong apparatus is provided for gripping a pipe. The apparatus includes a base and a housing coupled to the base. The housing is formed to include an interior region having a top opening. The apparatus also includes a jaw assembly extending through the top opening and into the interior region of the housing. The jaw assembly includes a lower clamp portion having a lower jaw, a linkage having a lower end coupled to the lower clamp portion and an upper end, and a cylinder having a movable piston. The cylinder is coupled to the upper end of the linkage. The apparatus further includes an upper clamp portion having an upper jaw, the upper clamp portion being coupled to the piston, and at least one removable stop extending through the housing adjacent the top opening. The at least one stop is located between the upper clamp portion and the cylinder to provide a mechanical stop for engaging the upper clamp portion upon retraction of the piston so that further retraction of the piston positively drives the cylinder, the linkage, and the lower clamp portion downwardly relative to the housing to disengage the lower jaw from the pipe.

In the illustrated embodiment, extension of the piston from the cylinder causes the upper clamp portion initially to move downwardly until the upper jaw engages the pipe. Further extension of the piston positively drives the cylinder, the linkage, and the lower clamp portion upwardly relative to the housing and the pipe until the lower jaw engages the pipe to grip the pipe and prevent rotation of the pipe relative to the jaw assembly.

Also in the illustrated embodiment, first and second removable stops extend through the housing adjacent the top opening. The first and second removable stops are located on opposite sides of the piston. The removable stops are held in position in the housing by cotter pins extending through first and second ends of the removable stops. The removable stops retain the jaw assembly within the housing so that the tong apparatus can be operated in any orientation.

According to another aspect of the present invention, a power tong apparatus is provided for gripping and rotating a pipe. The apparatus includes a base, and first and second spaced apart support members coupled to the base. The first and second support members each are formed to include an arcuate groove. The apparatus also includes a jaw assembly having first and second end walls which are each formed to include an arcuate groove aligned with the arcuate grooves formed in the first and second support members, respectively. The apparatus further includes first and second circular bearings extending between the arcuate grooves of the first and second end walls and the arcuate grooves of the first and second support members, respectively, to pivotably couple the jaw assembly to the first and second support members, and a drive mechanism coupled to the jaw assembly for rotating the jaw assembly relative to the base.

According to yet another aspect of the present invention, a tong apparatus is provided for gripping a pipe. The apparatus includes a base, and a housing coupled to the base. The housing is formed to include an interior region having a top opening. The apparatus also includes a jaw assembly including first and second elongated side walls having upper ends and lower ends that extend through the top opening and into the interior region of the housing. The first and second side walls are formed to include first and second grooves, respectively, adjacent the lower ends. The jaw assembly further includes a lower clamp portion having a lower jaw. The lower clamp portion includes first and second tabs which are slidably coupled to the first and second grooves to couple the lower clamp portion to the first and second side walls. A cylinder having a movable piston is pivotably coupled between the first and second side walls adjacent the upper ends. An upper clamp portion is formed to include a groove for slidably coupling the upper clamp portion to a notched portion of the piston. The upper and lower clamp portions are located in the housing to retain the upper and lower clamp portions on the jaw assembly.

In the illustrated embodiment, the upper clamp portion is located between the first and second side walls of the jaw assembly to retain the upper clamp portion on the jaw assembly. The cylinder is pivotable relative to the first and second side walls to facilitate removal and replacement of the upper clamp portion.

According to a further aspect of the present invention, a tong apparatus is provided for gripping a pipe. The apparatus includes a base and a jaw assembly including a lower clamp portion having a lower jaw, a cylinder having a movable piston, a linkage for coupling the lower clamp portion to the cylinder, an upper clamp portion having an upper jaw, the upper clamp portion being coupled to the piston. The apparatus also includes a mechanical stop coupled to the base. The stop is configured to engage the upper clamp portion upon retraction of the piston so that further retraction of the piston positively moves the cylinder, the linkage, and the lower clamp portion relative to the base to disengage the lower jaw from the pipe.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
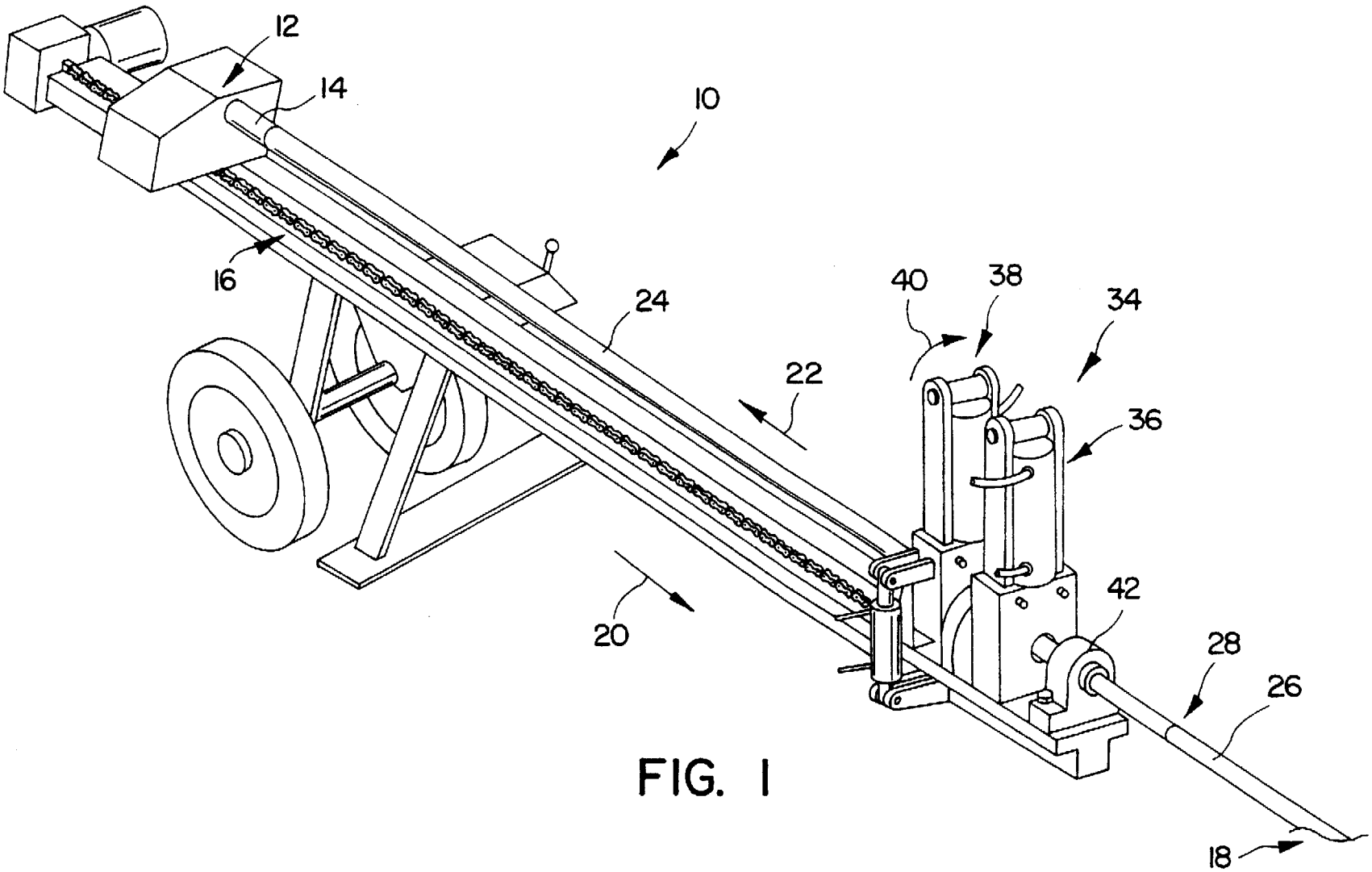
FIG. 1 is a perspective view illustrating a drilling rig having a main drive mechanism for inserting and removing sections of pipe into the ground with a break down tong apparatus of the present invention mounted on a front end of the drilling rig.

Referring now to the drawings, FIG. 1 illustrates a drilling rig 10 including a main drive unit 12 having a threaded drive head 14. Main drive unit 12 is driven back and forth over frame 16. Main drive unit 12 rotates threaded drive head 14 to drive pipe sections 24 and 26 into the ground 18. After lower pipe 26 is driven into the ground 18, upper pipe 24 is connected to a threaded end 32 of lower pipe 26 in order to continue driving the pipe into the ground 18. Main drive unit 12 rotates drive head 14 and pushes the pipe in the direction of arrow 20 to move the pipe into the ground 18. Pipe is also removed from the ground 18 using main drive unit 12 which rotates and pulls the pipe in the direction of arrow 22.

Figure 3:
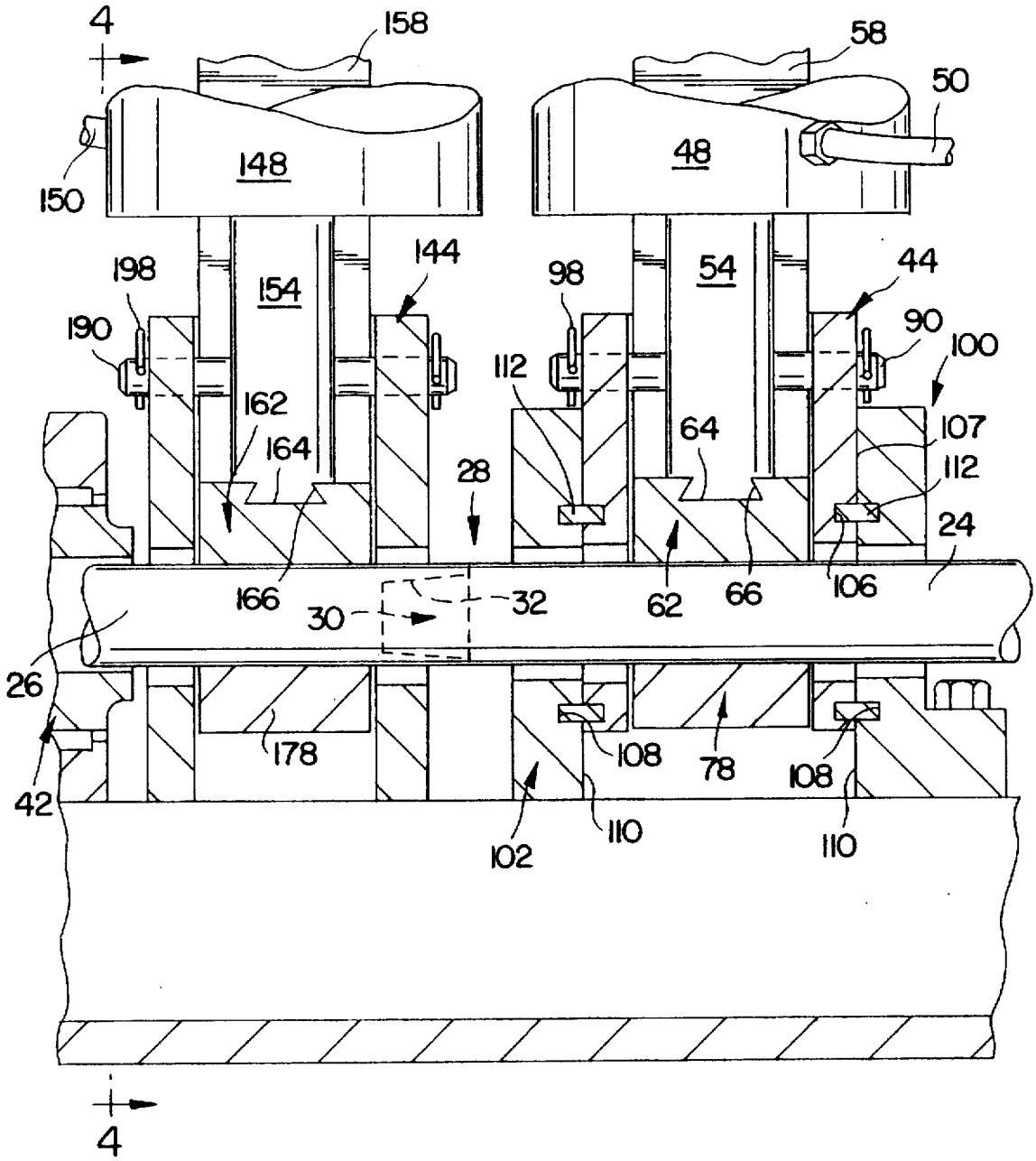
FIG. 3 is a sectional view taken along lines 3—3 of FIG. 2, illustrating the configuration of a power tong apparatus, a backup tong apparatus, and a bearing mounted adjacent the backup tong apparatus with a pipe joint coupling an upper pipe section to a lower pipe section located between the power tong apparatus and the backup tong apparatus.

In FIG. 1, an upper pipe section 24 is connected to threaded drive head 14 and a lower pipe section 26 is coupled to upper pipe 24 by a joint 28 as best illustrated in FIG. 3. Joint 28 includes a threaded male joint portion 30 of upper pipe 24 which is coupled to a threaded female joint portion 32 of lower pipe 26. In order to remove the upper pipe 24 from lower pipe 26, the joint 28 between upper pipe 24 and lower pipe 26 must be broken.

Although a portable drilling rig 10 is illustrated, it is understood that any type of drilling rig in any orientation can be used in accordance with the present invention. Drilling rig 10 can be positioned in a horizontal position as illustrated in FIG. 1 or in a vertical position for drilling straight down into the ground.

Referring again to FIG. 1, a break down tong apparatus 34 is provided to break the joint connection 28 between joint portions 30 and 32. Break down tong apparatus 34 includes a backup tong apparatus 36 which grips lower pipe 26 and holds lower pipe 26 stationary. Break down tong apparatus 34 also includes a power tong apparatus 38 which grips and rotates upper pipe 24 in the direction of arrow 40 to break the joint connection 28 between upper and lower joint sections 30 and 32. Break down tong apparatus 34 also includes a bearing 42 coupled to frame 16 adjacent backup tong apparatus 36. Bearing 42 surrounds lower pipe 26 to help align and stabilize the pipe as the pipe is driven into the ground 18 to reduce wear and tear on the backup tong apparatus 34 and power tong apparatus 38 as the pipe is driven into the ground 18.

Figure 2:
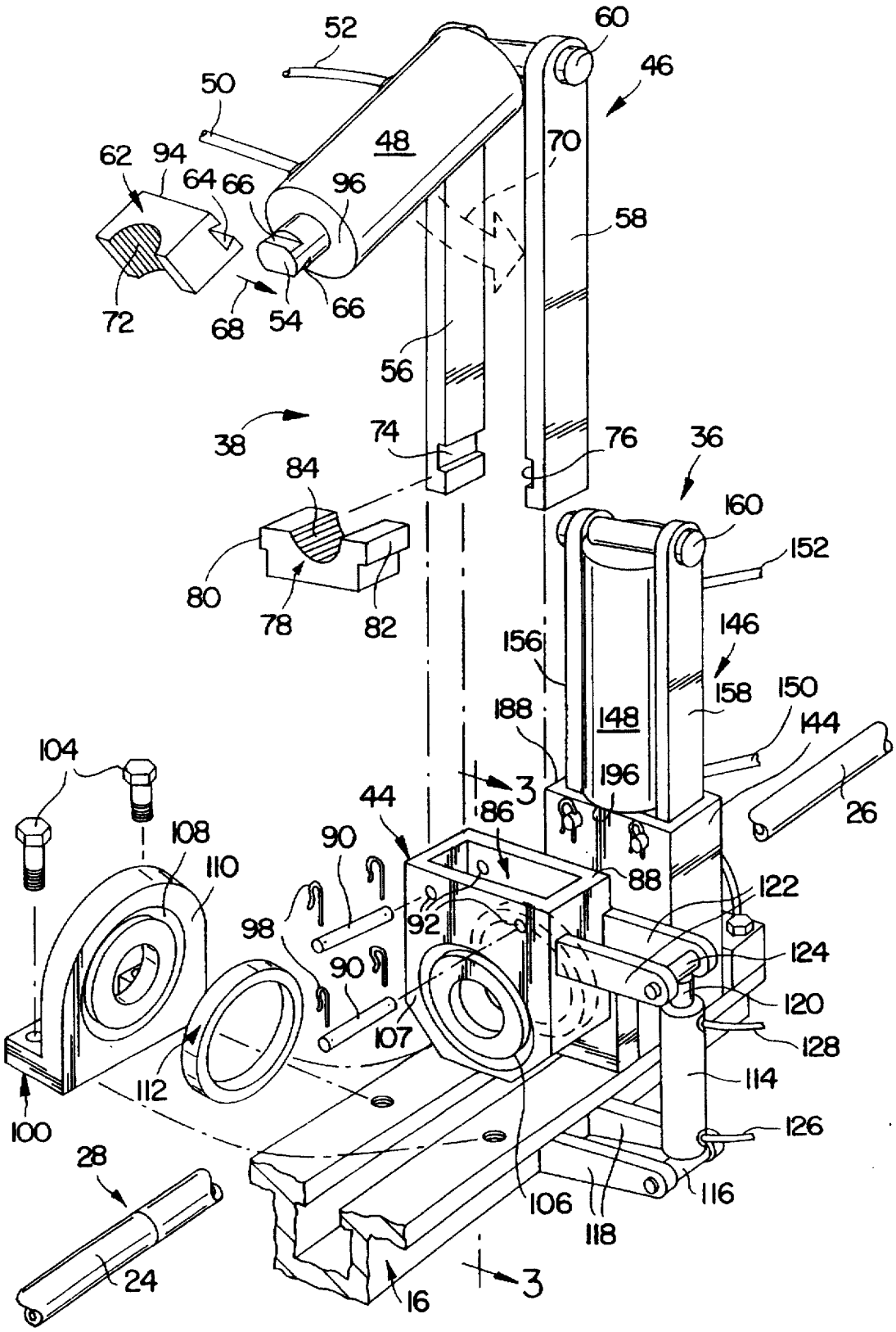
FIG. 2 is an exploded perspective view further illustrating details of the break down tong apparatus of FIG. 1.

Details of the break down tong apparatus 34 are illustrated in FIGS. 2 and 3. Referring to FIG. 2, components of the power tong apparatus 38 are illustrated in detail. Power tong apparatus 38 includes a housing 44 which is pivotably coupled to frame 16 as discussed below. Power tong apparatus includes a jaw assembly 46 having a cylinder 48 with standard hydraulic connections 50 and 52. A standard hydraulic system is used to control all the cylinders of the present invention. The hydraulic system moves a piston 54 from a retracted position to an extended position within cylinder 48.

Cylinder 48 is rotatably coupled to a linkage including first and second elongated side walls 56 and 58 by connection 60. Jaw assembly 46 includes an upper clamp 62 which is removably and slidably coupled to piston 54. Specifically, upper clamp 62 is formed to include a dovetail groove 64. Piston 54 is formed to include notched sections 66 for receiving dovetail groove 64 in the direction of arrow 68 to connect upper clamp 62 to piston 54. After upper clamp 62 is slidably coupled to piston 54, the entire cylinder 48 is rotated in the direction of arrow 70 so that upper clamp 62 lies between first and second side walls 56 and 58. This retains the upper clamp 62 in the jaw assembly 46. Upper clamp 62 includes a toothed upper jaw 72 for engaging a top portion of a pipe located in the power tong apparatus 38.

First and second side walls 56 and 58 are formed to include slots or grooves 74 and 76, respectively, adjacent lower ends. A lower clamp portion 78 is formed to include opposing tabs 80 and 82. Tabs 80 and 82 slide into grooves 74 and 76, respectively, to couple the lower clamp portion 78 to jaw assembly 46. Lower clamp portion 78 includes a toothed lower jaw 84 for engaging a bottom portion of the pipe located in the power tong apparatus 38.

After the jaw assembly 46 is assembled, a lower end of the jaw assembly 46 is positioned through top opening 88 and into an interior region 86 of housing 44. Therefore, the housing 44 retains the upper and lower clamp portions 62 and 78 inside the jaw assembly 46. The sliding connections between the upper clamp portion 62 and the piston 54 and the lower clamp portion 78 and the first and second side walls 56 and 58 provide a significant improvement over conventional devices. Advantageously, no tools are required to remove and replace the upper and lower clamp portions 62 and 78. No welding or fasteners are required. Therefore, the improved jaw assembly 46 of the present invention is cheaper to build, uses less steel, and is stronger than conventional jaw assemblies.

First and second removable stops/retainer pins 90 extend through an upper portion of housing 44 after the jaw assembly 46 is inserted. The pins 90 extend through apertures 92 formed in housing 44. Pins 90 are located between a top surface 94 of upper clamp portion 62 and a bottom surface 96 of cylinder 48. Cotter pins 98 hold the removable stops 90 in place within the housing 44. The pins 90 hold the jaw assembly 46 within housing 44 to permit the break down tong apparatus 34 to be operated in any orientation. In other words, the break down tong apparatus 34 can be used in either a horizontal or vertical drilling rig.

The retainer pins or mechanical stops 90 also provide positive raising and lowering of the cylinder 48 and lower clamp portion 78 during operation of the jaw assembly 46. Such operation will be described in detail below, with reference to FIGS. 4–6.

The housing 44 of the power tong apparatus 38 is rotatably coupled to the frame 16 by an improved bearing design. As illustrated in FIGS. 2 and 3, first and second support plates 100 and 102 are rigidly coupled to frame 16 on opposite sides of housing 44. For example, support plates 100 and 102 may be either bolted to frame 16 by fasteners 104, or welded directly to the frame 16. The improved bearing of the present invention includes arcuate grooves 106 formed in end walls 107 of housing 44 and corresponding arcuate grooves 108 formed in side walls 110 of support plates 100 and 102. Ring-shaped or circular bearing members 112 extend between arcuate grooves 106 of housing 44 and arcuate grooves 108 of support plates 100 and 102 as best illustrated in FIG. 3. The annular grooves 106 and 108 can be machined to very close tolerances.

The circular bearing member 112 is located within the annular grooves 106 and 108. There is no requirement for welding or bolting bearing components to the housing 44 or supports 100 and 102. The center bearing member 112 can be heat treated, if desired, so that the center ring is a harder metal than housing 44 or support plate 100. This reduces or eliminates galling, or surface damage between the mating, moving metal parts due to friction. The improved bearing has a very long life span and is very strong. The circular bearing members 112 must be sheared in order to break.

A drive cylinder 114 is pivotably coupled to frame 16 by a connection 116 extending between arm members 118. A piston 120 of drive cylinder 114 is pivotably coupled to arms 122 extending away from housing 44 by connection 124. Drive cylinder 114 is actuated by a conventional hydraulic control system through hydraulic lines 126 and 128.

Backup tong apparatus 36 includes similar components and operates in a manner similar to power tong apparatus 38. The only difference is that housing 144 is secured to frame 16 and does not rotate. Equivalent elements of the backup tong apparatus 36 are labeled with the same numbers as elements of the power tong apparatus 38, except that the elements of the backup tong apparatus 36 in the 100's series.

As discussed above, an important feature of the present invention is the positive stop for raising and lowering of the cylinder and lower jaw during actuation of the jaw assemblies 46 and 146. This feature is illustrated in FIGS. 4–6.

Figure 4:
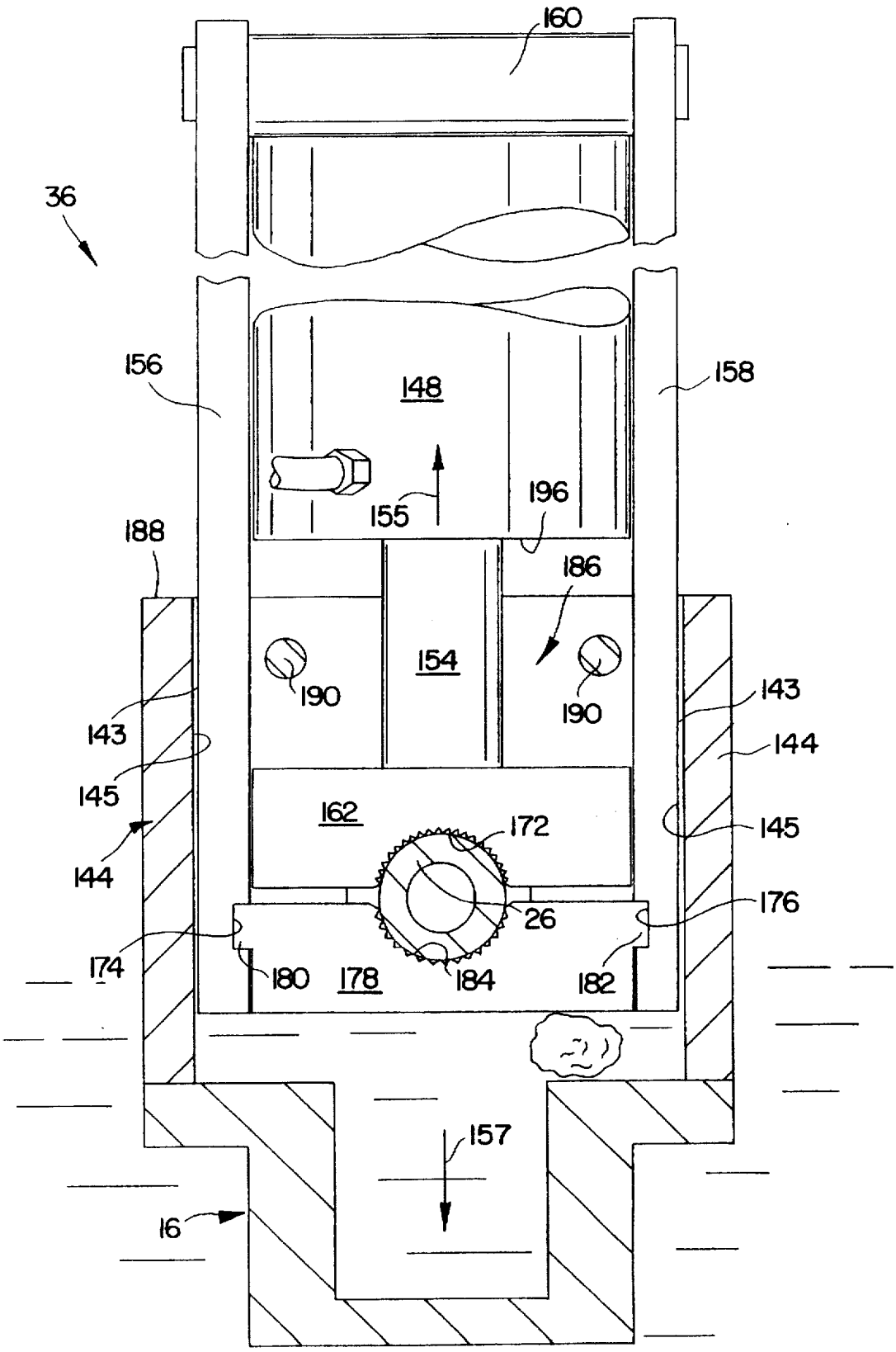
FIG. 4 is a sectional view taken along lines 4—4 of FIG. 3 illustrating the configuration of a jaw assembly including upper and lower jaws engaging and gripping the lower pipe section.

FIG. 4 illustrates the backup tong apparatus 36 in a clamped position on pipe 26. In other words, piston 154 has been extended so that upper jaw 172 and lower jaw 184 engage pipe 26 to prevent rotation of pipe 26 relative to the backup tong apparatus 36. There is a small clearance gap 143 between the first and second side walls 156 and 158 and the interior walls 145 of housing 144.

Figure 5:
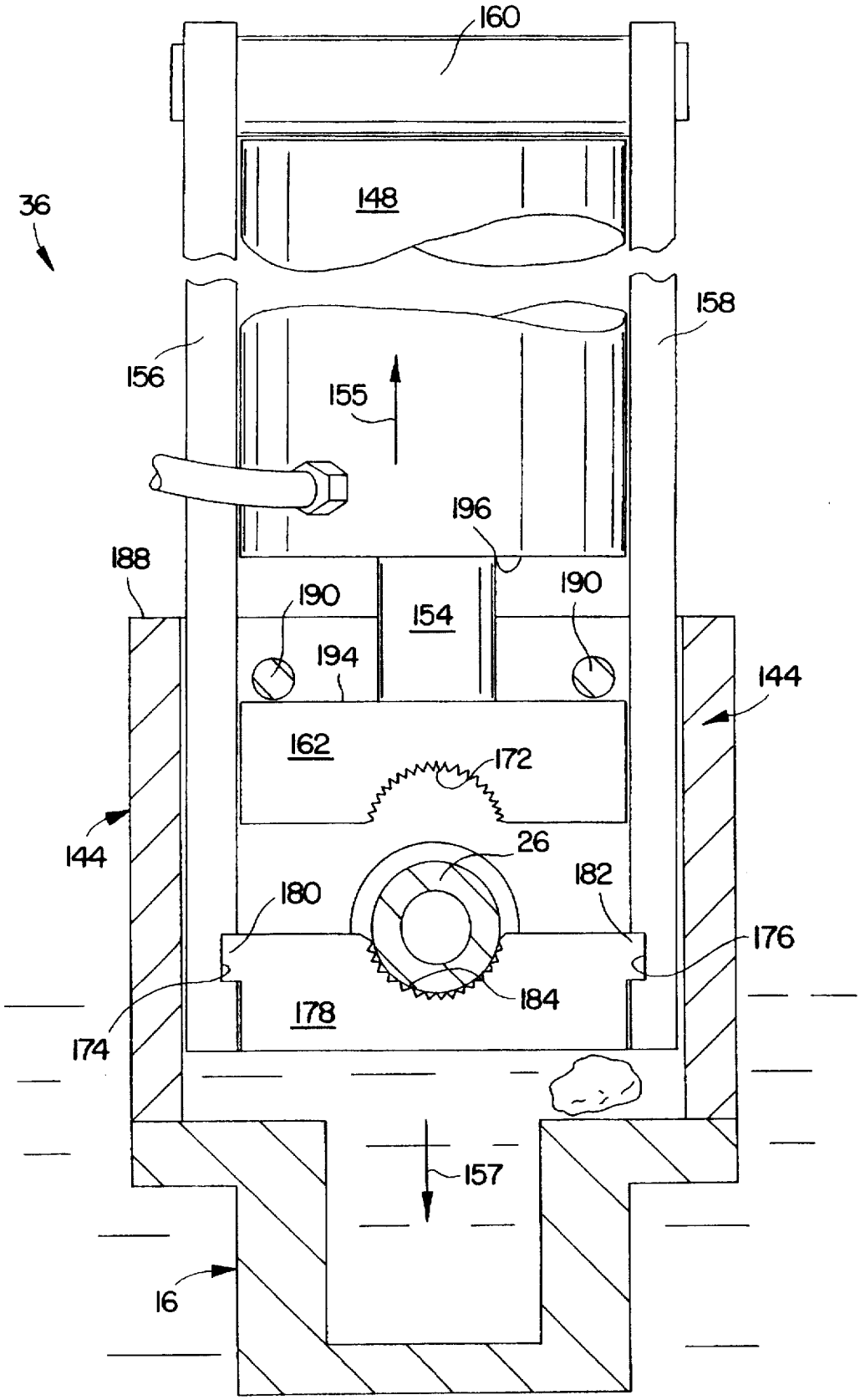
FIG. 5 is a sectional view similar to FIG. 4 in which a piston of the jaw assembly has been retracted to move the upper jaw away from the pipe, the upper jaw engaging a pair of removable stops/retainer pins which provide mechanical stops for limiting upward movement of the upper jaw.
Figure 6:
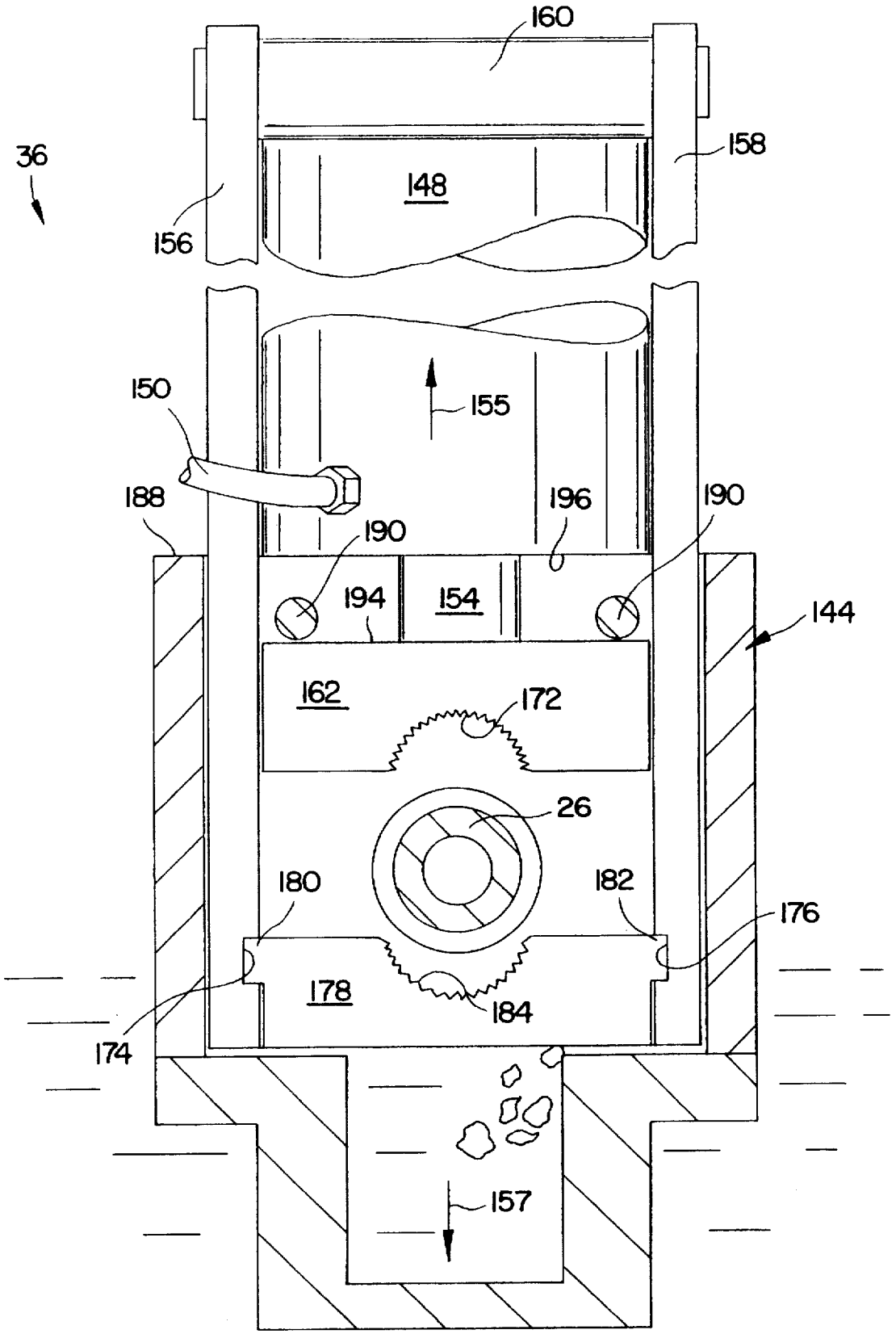
FIG. 6 is a sectional view similar to FIGS. 4 and 5 illustrating further retraction of the piston of the jaw assembly which provides a positive driving force to move the cylinder, a linkage including a pair of spaced apart side walls, and the lower jaw downwardly away from the pipe.

FIG. 5 illustrates initial retraction of piston 154 in the direction of arrow 155. Retraction of the piston 154 moves upper clamp portion 162 and upper jaw 172 upwardly away from pipe 26 in the direction of arrow 155. During normal operating conditions, the cylinder 148, the first and second side walls 156 and 158, and lower clamp portion 178 may drop down automatically in the direction of arrow 157 upon retraction of piston 154. However, in cold weather, ice can build up within housing 144. Therefore, the lower clamp 178 may not drop down automatically due to these freezing conditions. In addition, the break down tong apparatus 34 is typically operated in muddy conditions. Therefore, mud can build up inside housing 144 to block lower clamp portion 178 from dropping down automatically.

The removable stops 190 eliminate this problem that may exist during operation in cold weather or muddy conditions. As illustrated in FIG. 5, a top surface 194 of upper clamp 162 engages the mechanical stops 190 as the piston is retracted in the direction of arrow 155. The removable stops 190 have a high shear strength. Further retraction of piston 154 positively drives the cylinder 148, the first and second side walls 156 and 158, and the lower clamp portion 178 downwardly relative in the housing 144 in the direction of arrow 157 of FIG. 5. Therefore, lower jaw 184 is positively driven away from pipe 26 to the open position illustrated in FIG. 6. The pipe 26 is therefore free to move relative to the upper and lower jaws 172 and 184.

When in the position of FIG. 6, a bottom surface 196 of cylinder 148 engages top surface 188 of housing 144 as best illustrated in FIG. 2. There is clearance between top surface 194 of upper clamp 162 and stops 190 when the piston 154 is in the fully retracted position of FIG. 6.

In order to grip the pipe 26 from the open position of FIG. 6, the piston 154 is actuated and extended downwardly in the direction of arrow 157 until the upper jaw 172 engages the pipe 26. Further extension of the piston 154 positively drives the cylinder 148, the first and second side walls 156 and 158, and the lower clamp portion 178 upwardly in the direction of arrow 155 until the lower jaw 184 engages the pipe as illustrated in FIG. 4. Therefore, the jaw assembly 146 advantageously provides positive driving both to engage and to disengage the upper and lower jaws 172 and 184 from the pipe.

The improved break down tong apparatus 34 of the present invention can be built to any size to fit any size machine or drilling rig. The break down tong apparatus 34 provides a lightweight unit with fewer moving parts that is stronger than conventional devices. It is understood that the apparatus of the present invention may be built on a separate base plate which is then coupled to the frame 16.

Figure 7:
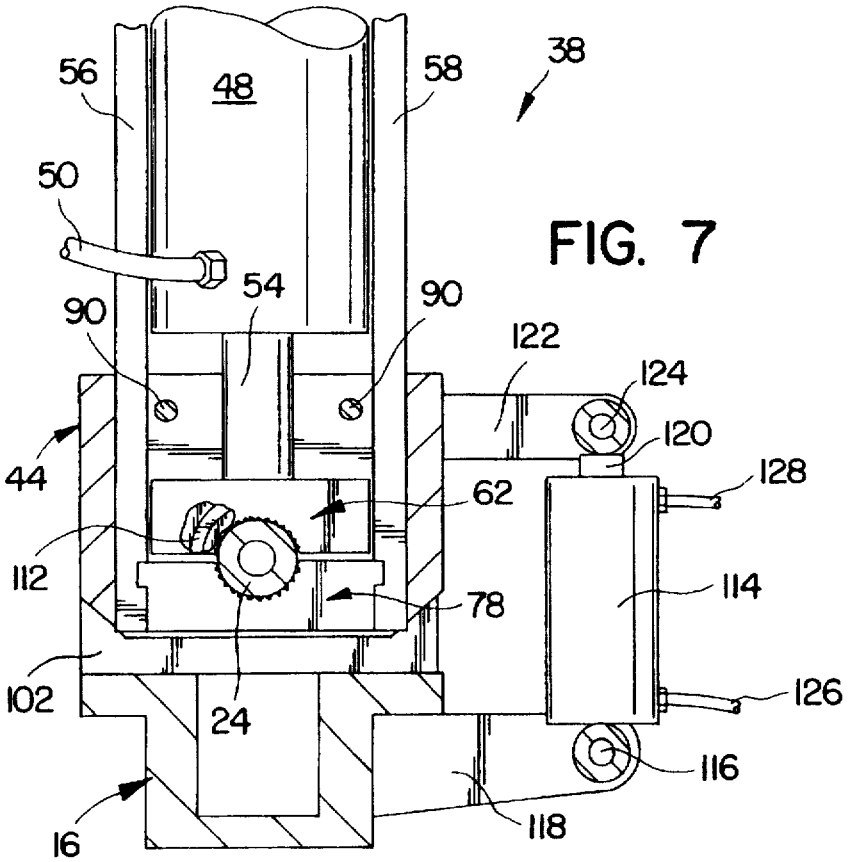
FIG. 7 is a sectional view taken through the power tong assembly of FIGS. 1 and 2 illustrating the upper and lower jaws engaged with the upper pipe section.
Figure 8:
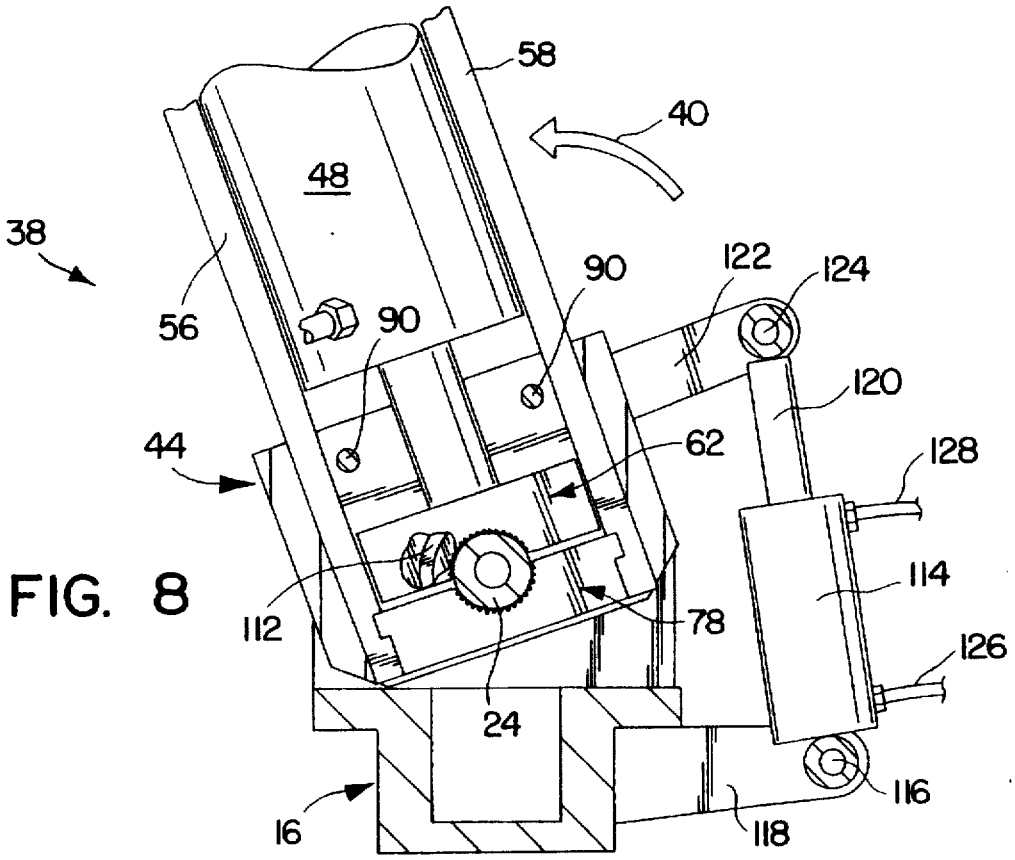
FIG. 8 is a sectional view similar to FIG. 7 in which a drive cylinder has been actuated to rotate the jaw assembly and housing of the power tong apparatus relative to the base to break the joint connection between the upper and lower pipe sections.

In operation, the main drive 12 pulls the upper and lower pipes 24 and 26 in the direction of arrow 22 of FIG. 1 with the jaw assemblies 46 and 146 open until the joint section 28 is located between the backup tong 36 and the power tong 38 as best illustrated in FIG. 3. The jaw assemblies 46 and 146 are then actuated to grip the pipe sections 24 and 26, respectively. FIG. 7 illustrates the power tong apparatus 38 gripping the upper pipe section 24. At this point, drive cylinder 114 is actuated to extend piston 120 and rotate the housing 44 and the jaw assembly 46 in the direction of arrow 40 shown in FIG. 8. This breaks the joint connection 28 between upper pipe 24 and lower pipe 26. The jaw assembly is typically rotated about 20° to break the joint connection 28 between the upper and lower pipe sections 24 and 26.

Jaw assembly 46 is then released from upper pipe section 24. Main drive 12 then continues to rotate the drive head 14 several revolutions to uncouple the upper pipe 24 from the lower pipe 26. Jaw assembly 46 is then actuated to clamp the pipe 24. Main drive 14 is then actuated to break the connection between upper pipe 24 and the main drive 14. The upper pipe section 24 can then be removed and stacked. Main drive unit 12 is then advanced in the direction of arrow 20 of FIG. 1 and drive head 14 is connected to the female joint portion 32 of lower pipe 26. Jaw assembly 146 of backup tong apparatus 36 is then released and main drive pulls the lower section of pipe 26 out of the ground in the direction of arrow 22.

When the next joint is positioned as illustrated in FIG. 3 between backup tong apparatus 36 and the power tong apparatus 38, the cycle is repeated to break the next joint. As illustrated in FIG. 3, backup tong apparatus 36 is spaced apart from power tong apparatus 38 to permit visual inspection of joint 28 between backup tong apparatus 36 and power tong apparatus 38.

The break down tong apparatus 34 can also be used to make up the pipe during insertion of pipe into ground 18 by drilling rig 10. In this instance, backup tongs 36 are actuated in a manner as discussed above to grip a lower section of the pipe when a joint is positioned between jaw assembly 146. Once upper jaw 172 and lower jaw 184 of backup tongs 36 are engaged with the joint section, the main drive 12 then breaks the drive head 14 loose from the pipe. The backup tongs 36 continue to hold the pipe joint until another section of the pipe can be loaded into drilling rig 10. After the new pipe section is coupled to the partially inserted section, backup tongs 36 releases the pipe to permit continued drilling.

Although the invention has been described in detail with reference to a certain preferred embodiment, variations and modifications exist within the scope and spirit of the present invention as described and defined in the following claims.

What is claimed is:

1. A tong apparatus for gripping a pipe, the apparatus comprising:

a base;

a housing coupled to the base, the housing being formed to include an interior region having a top opening;

a jaw assembly extending through the top opening and into the interior region of the housing, the jaw assembly including a lower clamp portion having a lower jaw, a linkage having a lower end coupled to the lower clamp portion and an upper end, a cylinder having a movable piston, the cylinder being coupled to the upper end of the linkage, and an upper clamp portion having an upper jaw, the upper clamp portion being coupled to the piston; and at least one removable stop extending through the housing adjacent the top opening, the at least one stop being located between the upper clamp portion and the cylinder to provide a mechanical stop for engaging the upper clamp portion upon retraction of the piston so that further retraction of the piston positively drives the cylinder, the linkage, and the lower clamp portion downwardly relative to the housing to disengage the lower jaw from the pipe.

2. The apparatus of claim 1, wherein extension of the piston from the cylinder causes the upper clamp portion initially to move downwardly until the upper jaw engages the pipe, and wherein further extension of the piston positively drives the cylinder, the linkage, and the lower clamp portion upwardly relative to the housing and the pipe until the lower jaw engages the pipe to grip the pipe and prevent rotation of the pipe relative to the jaw assembly.

3. The apparatus of claim 1, wherein first and second removable stops extend through the housing adjacent the top opening.

4. The apparatus of claim 3, wherein the first and second removable stops are located on opposite sides of the piston.

5. The apparatus of claim 1, wherein the at least one removable stop is held in position in the housing by cotter pins extending through first and second ends of the removable stop.

6. The apparatus of claim 1, wherein the at least one removable stop retains the jaw assembly within the housing so that the tong apparatus can be operated in any orientation.

7. The apparatus of claim 1, wherein the linkage includes first and second elongated side walls which are formed to include first and second grooves, respectively, adjacent the lower end of the linkage, and wherein the lower clamp portion is formed to include first and second tabs for slidably engaging the first and second grooves, respectively, to couple the lower clamp portion to the first and second side walls.

8. The apparatus of claim 7, wherein the lower clamp portion is located within the housing to retain the lower clamp portion in the first and second side walls.

9. The apparatus of claim 7, wherein the cylinder is pivotably coupled to the first and second side walls at the upper end of the linkage, the upper clamp portion includes a groove for slidably engaging a notched portion on a distal end of the piston to slidably couple the upper clamp portion to the piston, the upper clamp portion being located between the first and second side walls to retain the upper clamp portion on the piston.

10. The apparatus of claim 1, further comprising first and second spaced apart support members coupled to the base, the first and second support members each being formed to include an arcuate groove, the housing having first and second end walls which are each formed to include an arcuate groove aligned with the arcuate grooves formed in the first and second support members, respectively, and first and second circular bearings extending between the arcuate grooves of the first and second end walls and the arcuate grooves of the first and second support members, respectively, to pivotably couple the housing to the first and second support members.

11. A power tong apparatus for gripping and rotating a pipe, the apparatus comprising:

a base;

first and second spaced apart support members coupled to the base, the first and second support members each being formed to include an arcuate groove;

a jaw assembly having first and second end walls which are each formed to include an arcuate groove aligned with the arcuate grooves formed in the first and second support members, respectively;

first and second circular bearings extending between the arcuate grooves of the first and second end walls and the arcuate grooves of the first and second support members, respectively, to pivotably couple the jaw assembly to the first and second support members; and a drive mechanism coupled to the jaw assembly for rotating the jaw assembly relative to the base.

12. The apparatus of claim 11, wherein the first and second circular bearings are made from a heat treated metal material.

13. The apparatus of claim 11, wherein the jaw assembly includes a housing having said first and second end walls, the housing being formed to include an interior region having a top opening, the jaw assembly also including a lower clamp portion having a lower jaw, a linkage having a lower end coupled to the lower clamp portion and extending into the interior region of the housing and an upper end, a cylinder having a movable piston, the cylinder being coupled to the upper end of the linkage, and an upper clamp portion having an upper jaw, the upper clamp portion being coupled to the piston.

14. The apparatus of claim 13, further comprising at least one removable stop extending through the housing adjacent the top opening, the at least one stop being located between the upper clamp portion and the cylinder to provide a mechanical stop for engaging the upper clamp portion upon retraction of the piston so that further retraction of the piston positively drives the cylinder, the linkage, and the lower clamp portion downwardly relative to the housing to disengage the lower jaw from the pipe.

15. The apparatus of claim 14, wherein first and second removable stops extend through the housing adjacent the top opening, the first and second removable stops being located on opposite sides of the piston.

16. The apparatus of claim 13, wherein the linkage includes first and second elongated side walls which are formed to include first and second grooves, respectively, adjacent the lower end of the linkage, the lower clamp portion being formed to include first and second tabs for slidably engaging the first and second grooves, respectively, to couple the lower clamp portion to the first and second side walls, and wherein the upper clamp portion includes a groove for slidably engaging a notched portion on a distal end of the piston to slidably couple the upper clamp portion to the piston, the upper clamp portion being located between the first and second side walls to retain the upper clamp portion on the piston.

17. A tong apparatus for gripping a pipe, the apparatus comprising:

a base;

a housing coupled to the base, the housing being formed to include an interior region having a top opening;

a jaw assembly including first and second elongated side walls having upper ends and lower ends that extend through the top opening and into the interior region of the housing, the first and second side walls being formed to include first and second grooves, respectively, adjacent the lower ends, a lower clamp portion having a lower jaw, the lower clamp portion including first and second tabs which are slidably coupled to the first and second grooves to couple the lower clamp portion to the first and second side walls, a cylinder having a movable piston, the cylinder being pivotably coupled between the first and second side walls adjacent the upper ends, an upper clamp portion which is formed to include a groove for slidably coupling the upper clamp to a notched portion of the piston, the upper and lower clamp portions being located in the housing to retain the upper and lower clamp portions on the jaw assembly; and at least one removable stop extending through the housing adjacent the top opening, the at least one stop being located between the upper clamp portion and the cylinder to provide a mechanical stop for engaging the upper clamp portion upon retraction of the piston so that further retraction of the piston positively drives the cylinder, the linkage, and the lower clamp portion downwardly relative to the housing to disengage the lower jaw from the pipe.

18. The apparatus of claim 17, wherein the upper clamp portion is located between the first and second side walls of the jaw assembly to retain the upper clamp portion on the jaw assembly.

19. The apparatus of claim 18, wherein the cylinder is pivotable relative to the first and second side walls to facilitate removal and replacement of the upper clamp portion.

20. The apparatus of claim 17, wherein first and second removable stops extend through the housing adjacent the top opening, the first and second removable stops being located on opposite sides of the piston.

21. The apparatus of claim 17, further comprising first and second spaced apart support members coupled to the base, the first and second support members each being formed to include an arcuate groove, the housing having first and second end walls which are each formed to include an arcuate groove aligned with the arcuate grooves formed in the first and second support members, respectively, and first and second circular bearings extending between the arcuate grooves of the first and second end walls and the arcuate grooves of the first and second support members, respectively, to pivotably couple the housing to the first and second support members.

22. A tong apparatus for gripping a pipe, the apparatus comprising:

a base;

a jaw assembly including a lower clamp portion having a lower jaw, a cylinder having a movable piston, a linkage for coupling the lower clamp portion to the cylinder, an upper clamp portion having an upper jaw, the upper clamp portion being coupled to the piston; and a mechanical stop coupled to the base, the stop being configured to engage the upper clamp portion upon retraction of the piston so that further retraction of the piston positively moves the cylinder, the linkage, and the lower clamp portion relative to the base to disengage the lower jaw from the pipe.

* * * * *